US009267660B1

(12) United States Patent
Wang

(10) Patent No.: US 9,267,660 B1
(45) Date of Patent: Feb. 23, 2016

(54) FURNISHING LIGHT

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 23 days.

(21) Appl. No.: 14/459,325

(22) Filed: Aug. 14, 2014

(51) Int. Cl.

| | |
|---|---|
| ***H01R 33/00*** | (2006.01) |
| ***F21V 5/04*** | (2006.01) |
| ***F21V 3/02*** | (2006.01) |
| ***F21S 8/00*** | (2006.01) |
| ***F21V 23/04*** | (2006.01) |
| ***F21V 14/08*** | (2006.01) |
| *F21W 121/00* | (2006.01) |

(52) U.S. Cl.
CPC . *F21V 5/04* (2013.01); *F21S 8/035* (2013.01); *F21V 3/02* (2013.01); *F21V 14/08* (2013.01); *F21V 23/04* (2013.01); *F21W 2121/00* (2013.01)

(58) Field of Classification Search
CPC ..... F21S 8/035; F21V 3/02; F21V 5/04
USPC ..... 362/311.13, 351, 353, 363, 441, 455, 362/641, 644, 806, 808–809
See application file for complete search history.

(56) References Cited

U.S. PATENT DOCUMENTS 7,473,002 B1 * 1/2009 Chen ..... F21S 10/00 362/283

* cited by examiner

*Primary Examiner* — Jason Moon Han
(74) *Attorney, Agent, or Firm* — Leong C. Lei

(57) ABSTRACT

A furnishing light mainly includes a base, inside which provided with an illuminator, a projecting element with a transparent area encircling the illuminator, a lens positioned above the projecting element and a casing with a projecting area for encapsulating both the projecting element and lens. Thereby a light from the illuminator projects a contour of the transparent area to the casing meanwhile refracts through the lens to distribute over the projecting area.

7 Claims, 6 Drawing Sheets

FURNISHING LIGHT

TECHNICAL FIELD OF THE INVENTION

The present invention is related to a furnishing light, particularly a design used for enhancing a visual sensation of an environment through object installation and display.

DESCRIPTION OF THE PRIOR ART

Usually an indoor furnishing light is of a simple design in structure and thus monotonous without variety. Recently living standard of people has increased and therefore demand on decorating lights, which can enrich a living atmosphere or enhance visual sensation, has increased as well. A function of furnishing light is for not only illumination but also atmosphere enrichment and visual effect in order to attract consumers, increase their will of purchasing and strengthen product competitiveness.

Although the furnishing light of the prior art can achieve illumination effect, that alone without variety in decorating function is unlikely to have consumers' purchase.

SUMMARY OF THE INVENTION

An objective of the present invention is to enrich the visual effect of a furnishing light in order to strengthen its competitiveness.

Therefore the present invention is to provide a furnishing light that mainly includes:

a base, which has an upward opening, inside the base provided with a control circuit and at least an illuminator connected therewith;

a projecting element, which is in a cylinder shape encircling the illuminator and provided with a transparent area and an opaque area;

a lens, which is positioned at a top of the projecting element; and a casing, which is in a hollow and transparent three-dimension form with a downward opening, is securely connected to a top of the base so as to encapsulate both the projecting element and the lens and provided with a projecting area, which is corresponding with the lens.

Thereby when the base is turned on with electricity supplied, a light produced by the illuminator will transmits through the transparent area of the projecting element so as to project a contour of the transparent area onto the casing. Further, a portion of the light transmits and refracts through the lens so as to project the contour of the projecting area out of the casing for enhancing the decorating effect of the present invention.

DETAILED DESCRIPTION OF THE PREFERRED EMBODIMENTS

Figure 1:
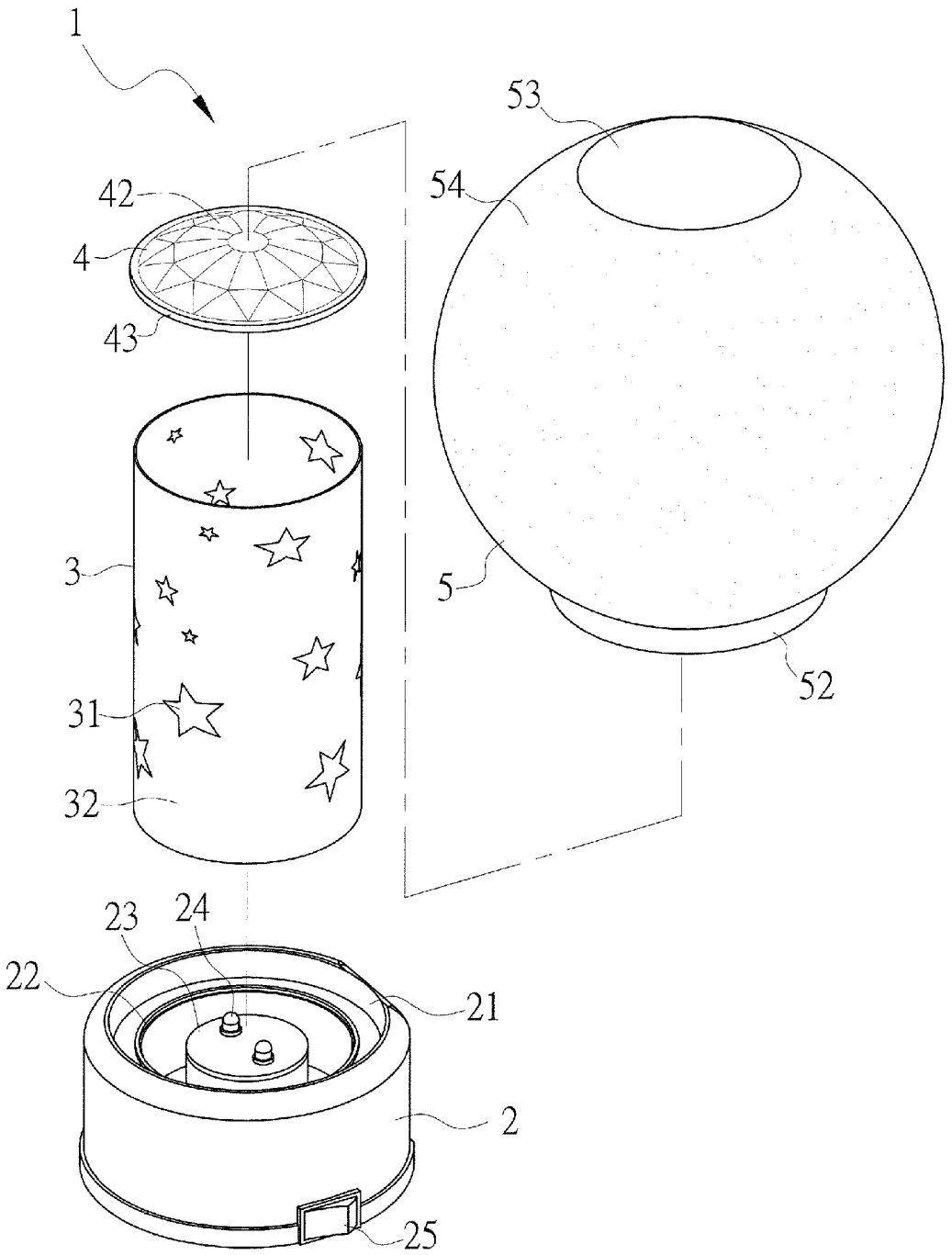
FIG. 1 is a schematic diagram illustrating a disassembly of a preferred embodiment of the present invention.
Figure 2:
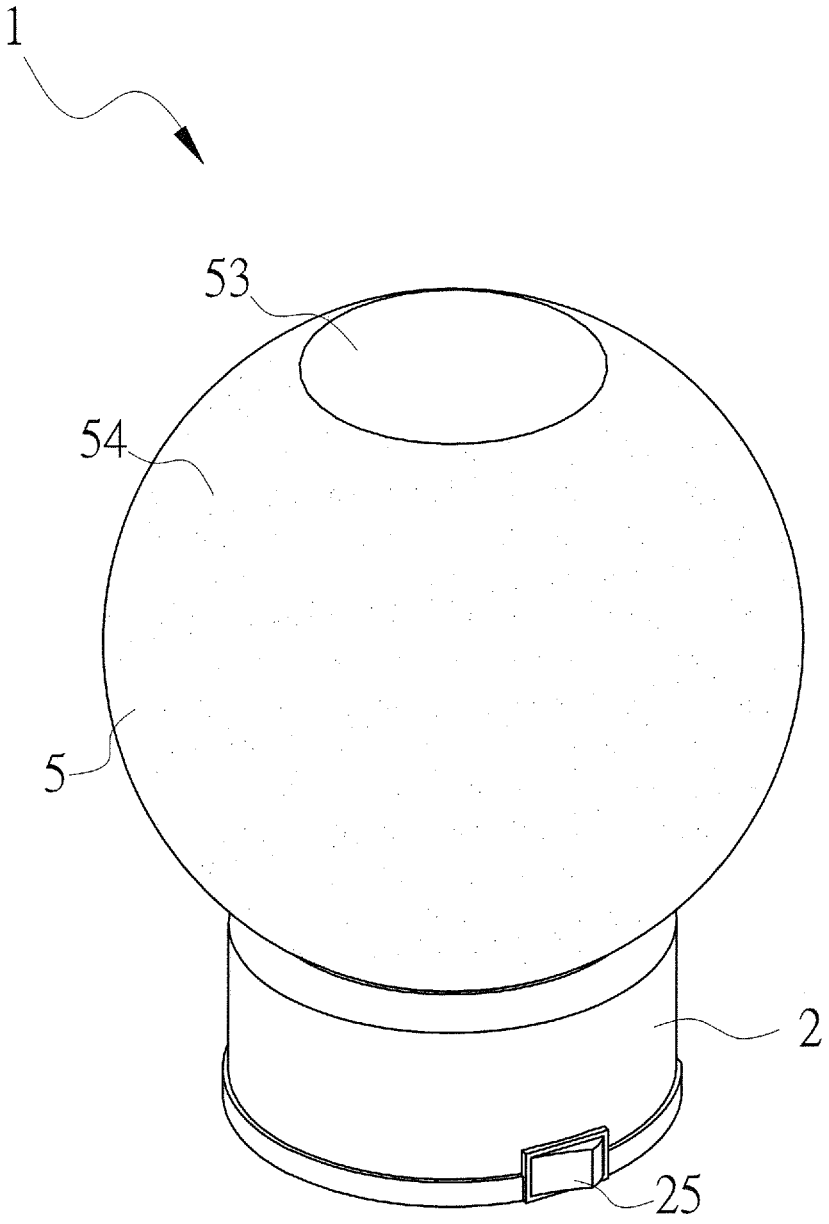
FIG. 2 is a schematic diagram illustrating an assembly of the preferred embodiment of the present invention.
Figure 3:
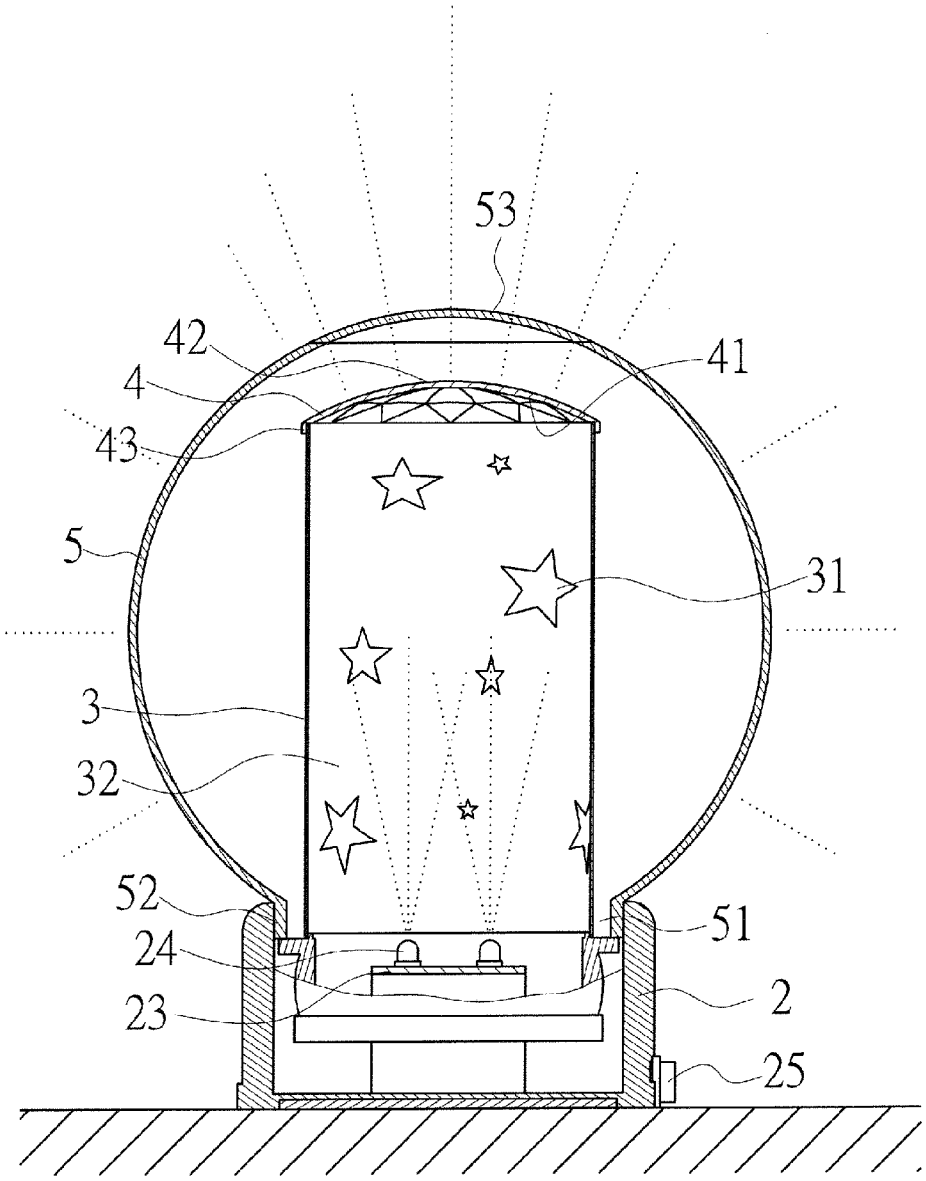
FIG. 3 is a schematic diagram illustrating a cross-section of the preferred embodiment of the present invention.
Figure 3A:
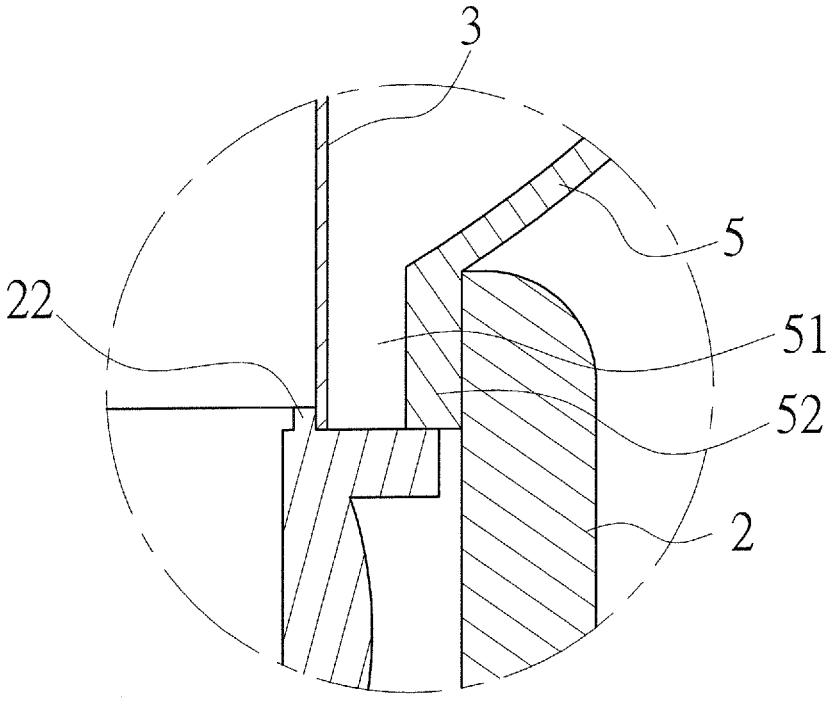
FIG. 3*a* is a schematic diagram illustrating a local enlarged view of FIG. 3.

Please refer FIGS. 1 to 3*a* illustrating a preferred embodiment of a furnishing light (1) of the present invention, which is a suitable structure for decoration or dim-light, including a base (2), a projecting element (3), a lens (4) and a casing (5) that the projecting element (3) is positioned at the base (2), the lens (4) is positioned at a top of the projecting element (3) and the casing (5) is securely connected to a top of the base (2) so as to encapsulate both the projecting element (3) and the lens (4).

The base (2) is provided with an upward opening (21), underneath which a flange (22) is provided, that a control circuit (23) and multiply illuminators (24), which are electrically connected therewith, are provided inside the base (2). In this embodiment the illuminators (24) are LED bulbs that are controlled by the control circuit (23) for their flashing frequency and change in colors. Further an outer circumference of the base (2) is provided with a switch (25), which is electrically connected with the control circuit (23). An electricity source to the base (2) can be one of a battery, an alternate current supply or a direct current supply that the electricity source is of broad variety and therefore omitted as its exclusion in the scope of claim of the present invention.

The projecting element (3) is in a cylinder shape, which encircles the illuminators (24), to be embedded to an outer periphery of the flange (22) of the base (2) and then applied with adhesive so as to securely position the projecting element (3) to the base (2). The projecting element (3) is provided with a transparent area (31) and an opaque area (32) as made of flexible and transparent plastic film. The opaque area (32) is by a treatment of painting, tap application or other means in order to shade the transmission of light and thus leave the area without treatment in a transparent state. The transparent area (31) can be in a form of figure, character, geometry texture, and so on that multiply star figures are used for illustration purpose in this embodiment.

The lens (4) is in a shape of cap, securely positioned at a top of the projecting element (3) and configured with a slope area (41), which consists of multiply slopes, at a surface toward the base (2) while a convex area (42) is configured at a surface of the lens (4) opposite to the base (2). A skirt edge (43) is extended at a circumference of the lens (4) in order to match a circumference of the projecting element (3) so as to constrain a radial movement of the lens (4) at the top of the projecting element (3).

The casing (5) is securely connected to the top of the base (2), in a form of hollow and transparent sphere and provided with a downward opening (51) from which a pipe section (52) is extended downward. In this embodiment the pipe section (52) of the casing (5) is used to insert into the opening (21) of the base (2) such that the casing (5) encircles both the projecting element (3) and the lens (4). The casing (5) is provided with a projecting area (53), which is corresponding to the lens (4), in a transparent state that an area of the casing (5) other than the projecting area (53) is provided with a texture (54), which can be by matte treatment or treatment with texture. In this preferred embodiment matte treatment is used for illustration purpose.

According to the above-mentioned, when the base (2) is turned on with electricity supplied, the illuminators (24) produce an upward light that is distributed inside the projecting element (3) and then transmits through the transparent area (31) outward so as to project a contour thereof onto the casing (5). Further, a portion of the light transmits into the slope area (41) of the lens (4) and then refracts through the convex area (42) that the contour of the transparent area (31) is thus projected at the slope area (41) of the lens (4) for enhancing the decorating effect of the present invention.

Figure 4:
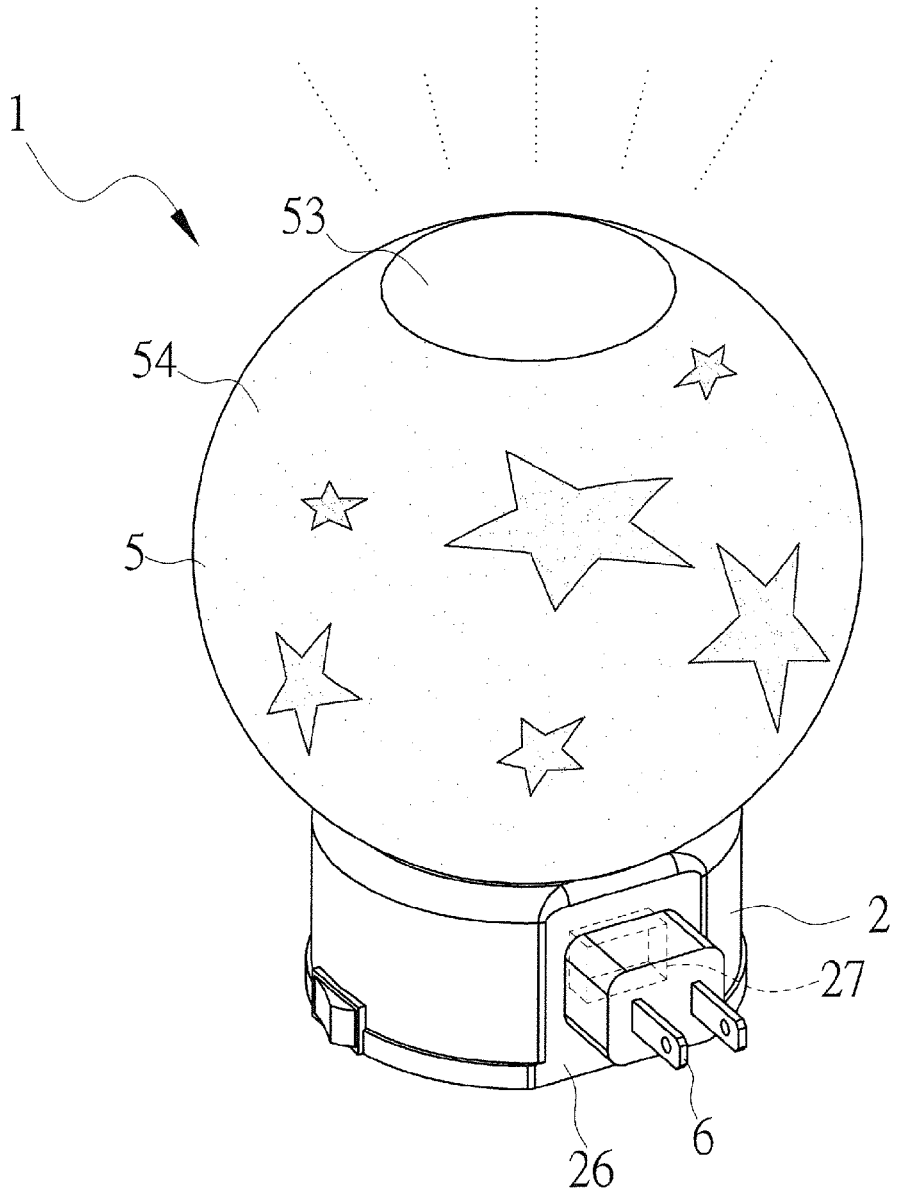
FIG. 4 is a schematic diagram illustrating a dim-light assembly as the other preferred embodiment of the present invention.
Figure 5:
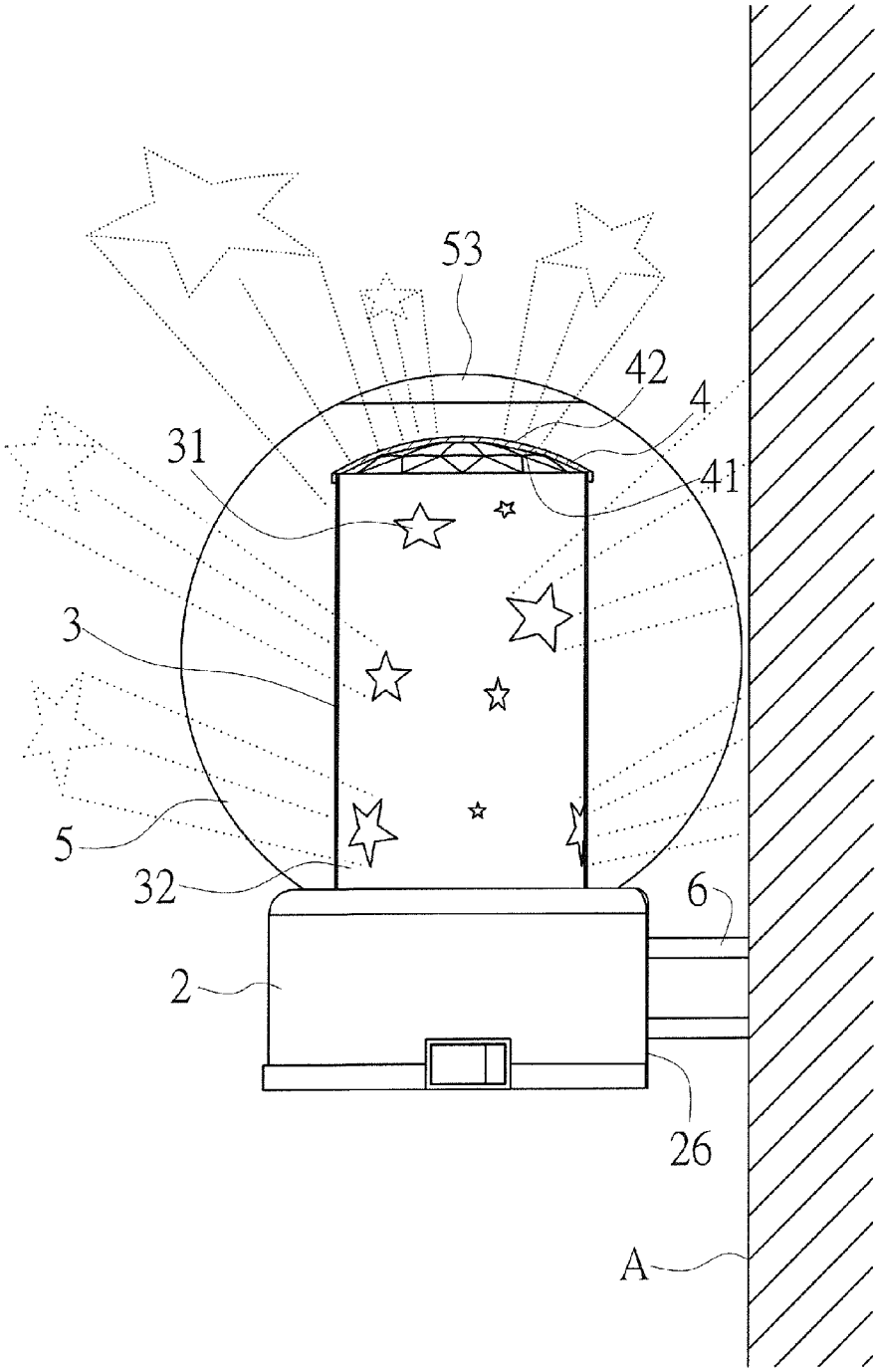
FIG. 5 is a schematic diagram illustrating a cross-section of the dim-light assembly of the other preferred embodiment of the present invention.

Please refer FIGS. 4 and 5 illustrating the other embodiment of a dim-light of the present invention. A portion of the outer circumference of the base (2) is formed as a flat surface (26) within which a hole (27) is provided for physically connecting an internal space of the base (2) that a dim-light plug (6) is installed at the hole (27) and electrically connected with the control circuit (23).

Thereby the dim-light embodiment of the present invention is to use the plug (6) installed at the base (2) for plugging into a socket on a wall (A) for conducting electricity. The transmission of light is the same as the above-mentioned embodiment with a deviation because the dim-light is usually placed near the wall (A) that the contour of the transparent area (31) of the projecting element (3) is projected on the casing (5) and then to the wall (A) while the projection on the slope area (41) of the lens (4) is projected to the wall (A) at the same time. Therefore a visual sensation of light and shadow is produced at the wall (A) near the dim-light.

Further a motor, which is electrically connected with the control circuit (23), and a turn-table driven thereby can be installed inside the base (2) that the projecting element (3) is positioned to the turn-table. When the present invention is turned on with electricity supplied, the turn-table will rotate together with the projecting element (3) that the light passing through the transparent area (31) of the projecting element (3) will have a dynamic effect. Because the mentioned motor and turn-table are structures of prior art, they are omitted from the figures.

I claim:

1. A furnishing light comprising a base, having an upward opening while inside said base provided with a control circuit and at least an illuminator connected therewith;

a projecting element, in a cylinder shape encircling the illuminator while provided with a transparent area and an opaque area;

a lens, positioned at a top of said projecting element; and a casing, in a hollow and transparent three-dimension form with a downward opening, is securely connected to a top of said base for encapsulating said projecting element and said lens while provided with a projecting area corresponding with said lens.

2. The furnishing light of claim 1 wherein an outer circumference of said base is provided with a socket for a dim-light that is electrically connected with the control circuit.

3. The furnishing light of claim 1 wherein said lens is configured with a slope area, which consists of multiply slopes, at a surface oriented toward said base.

4. The furnishing light of claim 1 wherein said base is provided with a flange that one side of said projecting element is embedded to an outer periphery of the flange.

5. The furnishing light of claim 1 wherein a sidewall other than the projecting area of said casing is provided with a decorating figure and texture.

6. The furnishing light of claim 1 wherein the transparent area of said projecting element is in a form of figure or character.

7. The furnishing light of claim 1 wherein the outer circumference of said base is provided with a switch that is electrically connected with the control circuit.

* * * * *